US006979940B2

(12) United States Patent
Kurachi et al.

(10) Patent No.: US 6,979,940 B2
(45) Date of Patent: Dec. 27, 2005

(54) ELECTRODELESS DISCHARGE LAMP

(75) Inventors: Toshiaki Kurachi, Osaka (JP); Kenji Itaya, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 68 days.

(21) Appl. No.: 10/445,117

(22) Filed: May 23, 2003

(65) Prior Publication Data

US 2003/0222557 A1 Dec. 4, 2003

(30) Foreign Application Priority Data

May 28, 2002 (JP) ..... 2002-153383

(51) Int. Cl.[7] ..... H01J 1/50; H01J 7/24
(52) U.S. Cl. ..... 313/46; 313/33; 313/161
(58) Field of Search ..... 313/46, 161, 60, 313/7, 234, 33, 4, 85, 486, 31; 315/248, 344, 315/326

(56) References Cited

U.S. PATENT DOCUMENTS

| | | | | |
|---|---|---|---|---|
| 4,536,675 A | | 8/1985 | Postma | |
| 4,661,746 A | | 4/1987 | Postma et al. | |
| 5,258,683 A | | 11/1993 | Eggink et al. | |
| 5,708,331 A | * | 1/1998 | Vamvakas et al. | 315/248 |
| 5,801,493 A | | 9/1998 | Antonis et al. | |
| 5,811,914 A | * | 9/1998 | Eijkens | 313/51 |
| 6,081,070 A | * | 6/2000 | Popov et al. | 313/490 |
| 6,555,954 B1 | * | 4/2003 | Chandler et al. | 313/485 |
| 6,642,671 B2 | * | 11/2003 | Kurachi et al. | 315/248 |
| 6,768,248 B2 | * | 7/2004 | Chandler et al. | 313/46 |
| 2002/0067129 A1 | * | 6/2002 | Chamberlain et al. | 313/607 |

FOREIGN PATENT DOCUMENTS

| | | |
|---|---|---|
| JP | 5-27945 | 4/1993 |
| JP | 6-6448 | 2/1994 |
| JP | 09231949 A | 9/1997 |
| JP | 10069992 A | 3/1998 |
| JP | 2001273873 A | 10/2001 |
| JP | 2002093380 A | 3/2002 |
| JP | 2002175782 A | 6/2002 |

* cited by examiner

*Primary Examiner*—Karabi Guharay
*Assistant Examiner*—German Colón
(74) *Attorney, Agent, or Firm*—Harness, Dickey & Pierce, P.L.C.

(57) ABSTRACT

An electrodeless discharge lamp includes an induction coil that includes a core and a winding wound around the core and generates an electromagnetic filed inside a bulb, an insert portion provided inside the core, and a plane portion that releases heat from the insert portion to the outside of a case. A tolerance in the inductance of the induction coil is reduced by spacing the end portion of the core on the side of the plane portion apart from the plane portion, which makes reliable start-up possible.

20 Claims, 5 Drawing Sheets

ELECTRODELESS DISCHARGE LAMP

BACKGROUND OF THE INVENTION

The present invention relates to an electrodeless discharge lamp in which an induction coil is arranged in a cavity provided in a bulb, in particular, an electrodeless discharge lamp having a thermal conductive member.

Conventionally, electrodeless discharge lamps using inductive coupling plasma have been used for illumination of public facilities such as roads or bridges for the purpose of reducing the maintenance cost, because they have a long lifetime. However, in a recent trend, the electrodeless discharge lamps are increasingly used as a light source alternative to incandescent lamps in hotels or restaurants because they have high efficiency and long lifetime. In the development of the electrodeless discharge lamps, efforts are put to achieve a lamp having good start-up properties and a high efficiency, that is, to supply power to a discharge bulb from a commercial power source via ballast circuits as efficiently as possible.

Conventionally, in order to supply electromagnetic energy to the discharge bulb of an electrodeless discharge lamp efficiently, it is general to attempt to achieve impedance matching between an inverter circuit and a load resonance circuit (matching circuit) included in the ballast circuit so as to supply the maximum power to the induction coil. In this case, the electromagnetic energy supplied to the discharge bulb via the induction coil is affected significantly by the inductance of the induction coil included in the load resonance circuit. That is to say, if the inductance of the induction coil is even only slightly outside of the designed value (e.g., 2 to 3%), the resonance frequency of the load resonance circuit is not matched to the operating frequency of the inverter circuit (driving frequency of the switching element). Thus, if the two frequencies are unmatched even slightly, the resonance voltage applied across the induction coil is reduced significantly, so that the electrodeless discharge lamp cannot be started.

For this reason, it is desirable that the impedance element constituting the load resonance circuit has no tolerance in the characteristics so that the resonance frequency can be constant. In this background, Japanese Laid-Open Patent Publication No. 10-69992 discloses a movable cylinder for fine tuning of coil inductance for the purpose of fine tuning of the tolerance in the impedance of the inductance coil.

Furthermore, the operation and the efficiency of the electrodeless discharge lamp are affected by the temperature characteristics of ferrite that is a magnetic material used as the core of the inductance coil. When the temperature of the core is increased by the heat generated in the core of the induction coil, the magnetic permeability of the core is reduced. An electrodeless discharge lamp in which a thermal conductive member that dissipates the heat generated in the core efficiently is provided in order to prevent the reduction of the magnetic permeability due to this temperature increase is put into practice. For example, Japanese Utility Model No. 6-6448 discloses an electrodeless discharge lamp in which a rod-shaped thermal conductive member is provided along the principal portion in the length of a cylindrical core. This publication No. 6-6448 also discloses a structure in which the heat of the core transmitted to the rod-shaped or cylindrical thermal conductive member is transmitted to a case via a plane-shaped thermal conductive member provided perpendicularly to the core and is released to the outside of the case.

Japanese Patent Publication No. 5-27945 discloses an electrodeless discharge lamp in which a cylindrical thermal conductive member is provided along the inside of the core in order to effectively dissipate the heat generated in the inductance coil, and the thermal conductive member is electrically insulated from the metal housing including a power source unit to reduce the start-up voltage.

In order to ensure the start-up of the electrodeless discharge lamp, it is necessary to make the supply power to the discharge bulb as much as possible. For this, it is important to suppress tolerance in the inductance of the induction coil. This has been referred to in the description of prior art. Furthermore, the inductance of the induction coil is also affected by the arrangement relationship between the thermal conductive member provided in the electrodeless discharge lamp to dissipate the heat and the induction coil.

However, there has been no report that proposes specifically what to do in order to suppress the tolerance of the inductance that is generated by the arrangement relationship between the thermal conductive member and the induction coil.

SUMMARY OF THE INVENTION

Therefore, with the foregoing in mind, it is an object of the present invention to provide an electrodeless discharge lamp that suppresses tolerance in the inductance of the induction coil, and thus can be started reliably.

A first electrodeless discharge lamp of the present invention includes a substantially spherical bulb enclosing a discharge gas and having a cavity; an induction coil having a substantially cylindrical core made of a magnetic material and a winding wound around the core, arranged in the cavity, and generating an electromagnetic field inside the bulb; and a thermal conductive member having an insert portion a part of which is inserted in a cylindrical hole of the core, and a plane portion arranged outside the core and extending in a form of a brim from an end portion of the insert portion. The end portion of the core on the side of the plane portion is spaced apart from the plane portion by a first gap.

It is preferable that the first gap is 5.0 mm or more.

It is preferable that the first gap is 7.5 mm or more.

A second electrodeless discharge lamp of the present invention includes a substantially spherical bulb enclosing a discharge gas and having a cavity; an induction coil having a substantially cylindrical core made of a magnetic material and a winding wound around the core, arranged in the cavity, and generating an electromagnetic field inside the bulb; a thermal conductive member having an insert portion a part of which is inserted in a cylindrical hole of the core, and a plane portion arranged outside the core and extending in a form of a brim from an end portion of the insert portion; and a substantially plate-like shielding member made of a magnetic material that is arranged parallel to the plane portion between the core and the plane portion. The end portion of the core on the side of the plane portion is spaced apart from the shielding member by a second gap.

It is preferable that the second gap is 4.0 mm or more.

It is preferable that the second gap is 5.5 mm or more.

It is preferable that the shielding member contains ferrite or iron.

In one embodiment, the first gap or the second gap is formed by a spacer that is a protrusion.

It is preferable that the protrusion is made of a plastic material.

It is preferable that the electrodeless discharge lamp further includes a ballast circuit having a substrate for supplying power to the induction coil; and a holding member for holding the substrate, and that the protrusion is formed integrally with the holding member.

It is preferable that the insert portion and the plane portion are joined, and the radius of curvature of a connection portion where the insert portion and the plane portion are joined is 2 mm or less.

In one embodiment, a plurality of holes are provided in the plane portion.

It is preferable that the outer diameter of the plane portion is not less than the outer diameter of the shielding member.

It is preferable that a column-shaped cylindrical portion that releases heat from the plane portion to the outside is thermally connected to a periphery of the plane portion in the thermal conductive member.

It is preferable that the electrodeless discharge lamp further includes a case for covering the ballast circuit, and the cylindrical portion is thermally connected to the case.

It is preferable that the electrodeless discharge lamp further includes a lamp base for receiving commercial power, and the bulb, the induction coil, the ballast circuit and the lamp base are formed integrally.

DETAILED DESCRIPTION OF THE INVENTION

Hereinafter, embodiments of the present invention will be described.

Embodiment 1

Hereinafter, an electrodeless discharge lamp of Embodiment 1 of the present invention will be described with reference to FIG. 1.

Figure 1:
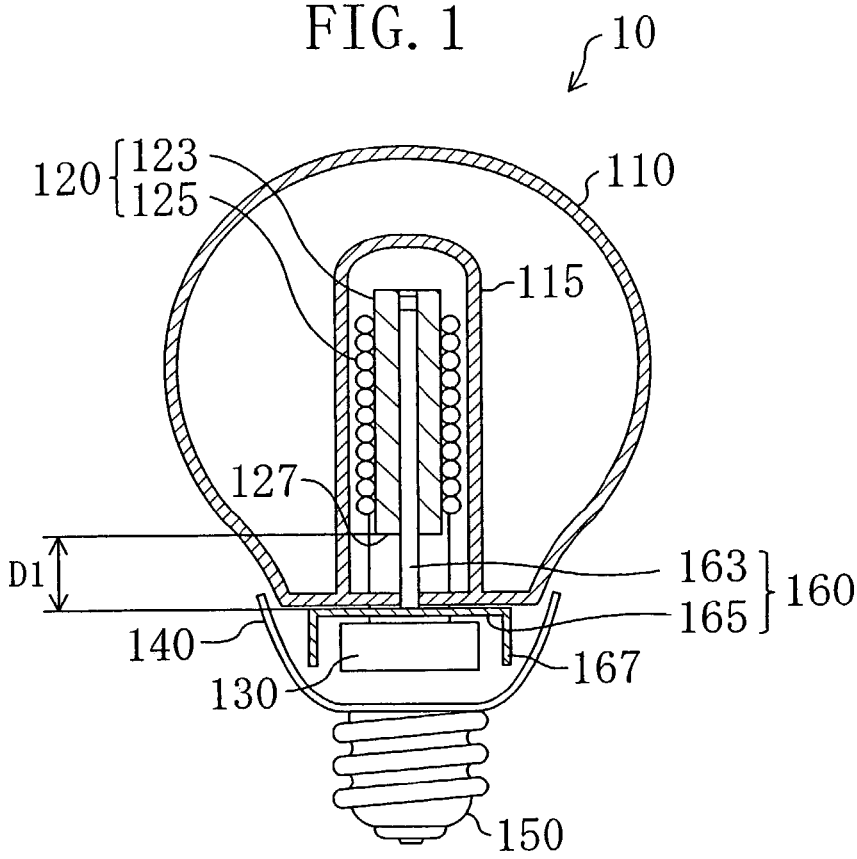
FIG. 1 is a schematic cross-sectional view of a relevant portion of an electrodeless discharge lamp of Embodiment 1 of the present invention.

FIG. 1 is a cross-sectional view of a relevant portion showing the outline of the structure of an electrodeless discharge lamp 10 of this embodiment of the present invention. In FIG. 1, the electrodeless discharge lamp 10 has a translucent incandescent lamp-shaped bulb 110 made of soda glass, and the bulb 110 has a cavity 115. Inside the bulb 110, mercury (not shown) as a main luminous material and a rare gas (not shown) such as argon or krypton as a buffer gas are enclosed. A phosphor layer (not shown) to which a phosphor is applied is formed on the inner surface of the bulb 110, and ultraviolet radiation generated by excitation effect of the mercury enclosed in the bulb 110 is converted to visible radiation at this phosphor layer. An induction coil 120 constituted by a cylindrical core 123 made of ferrite, which is a magnetic material, and a winding 125 wound around the core 123 is provided in the cavity 115 of the bulb 110. The winding 125 in FIG. 1 is shown in its cross-section. The length L of the core 123 is 45 mm, and Mn—Zn ferrite (a magnetic permeability of about 2,300) is used for the core. A litz wire is used as the winding 125 and the number of windings is 42 turns.

The winding 125 is connected to a ballast circuit 130 for supplying high-frequency current to the induction coil 120. The ballast circuit 130 includes electronic components such as a semiconductor, a capacitor, a resistor, and a choke coil, and a printed circuit board on which these electronic components are provided. The ballast circuit 130 is constituted by a rectifying circuit, a smoothing capacitor, an inverter circuit for converting smoothed direct current to alternating current, and a load resonance circuit for supplying power to excite the discharge gas in the bulb 110 via the induction coil 120, although not shown in FIG. 1. The driving frequency of the inverter circuit is 425 kHz.

The ballast circuit 130 is covered with a case 140 made of a plastic having high electric insulation properties and excellent heat resistance such as polybutylene terephthalate, and power is input to this ballast circuit 130 via a lamp base 150. The input power is commercial power. Thus, the electrodeless discharge lamp 10 of this embodiment is a self-ballasted electrodeless discharge lamp in which the bulb 110, the induction coil 120, the ballast circuit 130 and the lamp base 150 are formed integrally.

In this embodiment, a thermal conductive member 160 is provided in the electrodeless discharge lamp 10 so that the heat in the core 123 is released to the outside of the core 123. A pipe-like insert portion 163 made of copper having a high thermal conductivity that releases the heat from the core 123 is inserted in the cylindrical hole of the core 123 in such a manner that it is thermally in contact with the core 123. The insert portion 163 is joined with a plane portion 165 made of copper having a high thermal conductivity that is extended in the form of a brim from the end portion of the insert portion 163 in the bottom of the bulb 110. The plane portion 165 is provided substantially orthogonally to the insert portion 163. This plane portion 165 serves to release the heat from the insert portion 163 to the outside of the case 140.

Furthermore, the plane portion 165 is coupled to a column-shaped cylindrical portion 167 made of copper so that the heat from the plane portion 165 is easily released to the outside of the case 140. In this embodiment, the cylindrical portion 167 is extended substantially perpendicularly from the periphery of the disk-like plane portion 165. The cylindrical portion 167 is extended in the direction opposite to the direction in which the insert portion 163 is extended from the plane portion 165. This cylindrical portion 167 is thermally connected to the case 140 by being in contact with the case 140 so that the heat can be released outside easily. Here, the thermal connection is achieved by a contact, but thermal connection can be achieved by mechanically connecting the cylindrical portion 167 and the case 140, or by conducting heat via a grease or the like. In FIG. 1, the plane portion 165 and the cylindrical portion 167 are shown in their cross-sections, but the insert portion 163 is not shown in its cross-section.

The heat generated in the induction coil 120 is first transmitted to the insert portion 163 made of copper, and then to the cylindrical portion 167 made of copper through the plane portion 165 made of copper. The heat transmitted to the cylindrical portion 167 is released to the outside of the electrodeless discharge lamp 10 via the case 140. Thus, the insert portion 163 and the plane portion 165 constitute a thermal conductive member 160, so that the heat generated in the induction coil 120 is efficiently dissipated from the cylindrical portion 167 to the outside of the electrodeless discharge lamp 10 through the case 140.

In the electrodeless discharge lamp 10 of Embodiment 1, the gap D1 (first gap) between the end portion 127 of the core 123 of the induction coil 120 on the side of the plane portion 165 and the plane portion 165 is set to 8 mm in order to suppress a tolerance in the inductance of the induction coil 120. In the following description, "the end portion 127" of the core 123 refers to the end portion of the core 123 on the side of the plane portion 165, unless otherwise specified.

Hereinafter, the reason why the gap D1 is set to 8 mm will be explained.

When the gap D1 between the end portion 127 of the core 123 and the plane portion 165 is changed, the inductance of the induction coil 120 is changed.

The inventors of the present invention examined experimentally the influence on the inductance of the induction coil 120 when a conductive material is placed near the end portion 127 of the core 123, and found that it is important to form a gap between the end portion 127 of the core 123 and the conductive material in order to stabilize the inductance.

Figure 2:
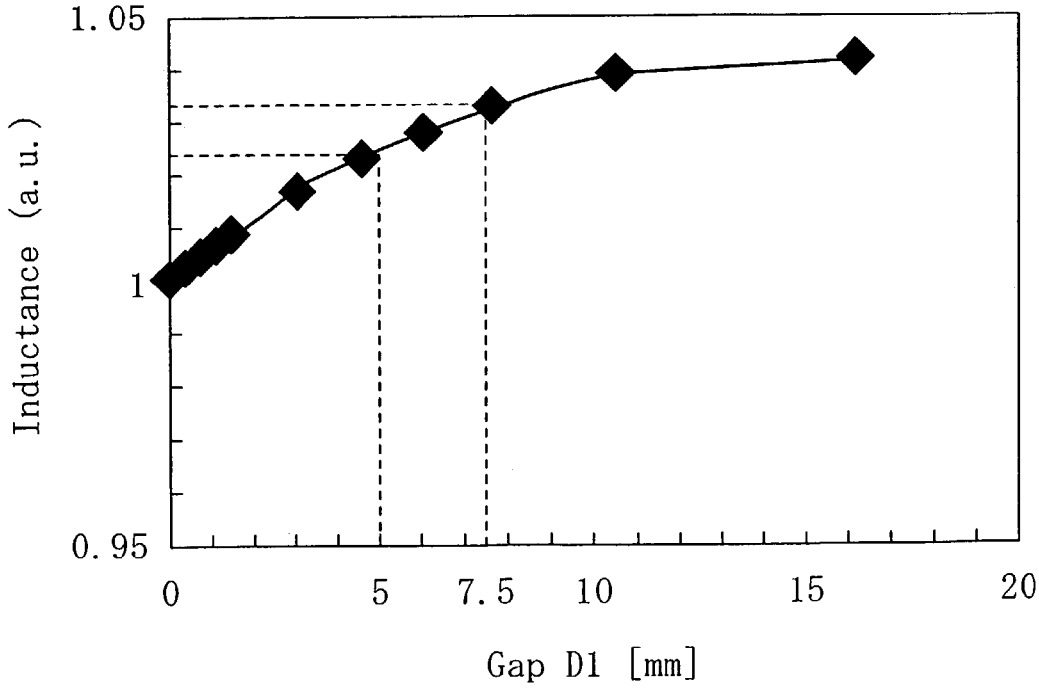
FIG. 2 is a graph showing the relationship between the gap D1 and the inductance of the induction coil.

Next, experiments and examinations are made as to what positional relationship between the core 123 and the plane portion 165 of the thermal conductive member 160, which is a conductive material, can suppress a tolerance of the inductance of the induction coil 120. FIG. 2 shows the results. In FIG. 2, the horizontal axis shows the gap D1 (mm) between the end portion 127 of the core 123 and the plane portion 165, and the vertical axis shows the values of the inductance of the induction coil 120, which are obtained by normalizing the value at a gap D1 of 0 mm as 1. The materials and the structures of the induction coil 120 and the thermal conductive member 160 used in the experiments are those described above, and are not described here again.

As seen from FIG. 2, after the gap D1 between the end portion 127 of the core 123 and the plane portion 165 reaches 5.0 mm or more, when the gap is changed by 1 mm, the tolerance ratio of the inductance of the induction coil 120 is 1% or less. After the gap D1 reaches 7.5 mm or more, the tolerance ratio of the inductance is 0.5% or less.

When the inductance of the induction coil 120 is changed, the resonance frequency of the resonance load circuit is changed, so that the driving frequency of the inverter circuit is slightly unmatched to the resonance frequency of the load resonance circuit. Therefore, even a small change in the inductance of the induction coil 120 causes the resonance voltage applied across the induction coil 120 for start-up (hereinafter, referred to simply as "start-up coil voltage") to change significantly.

Figure 3:
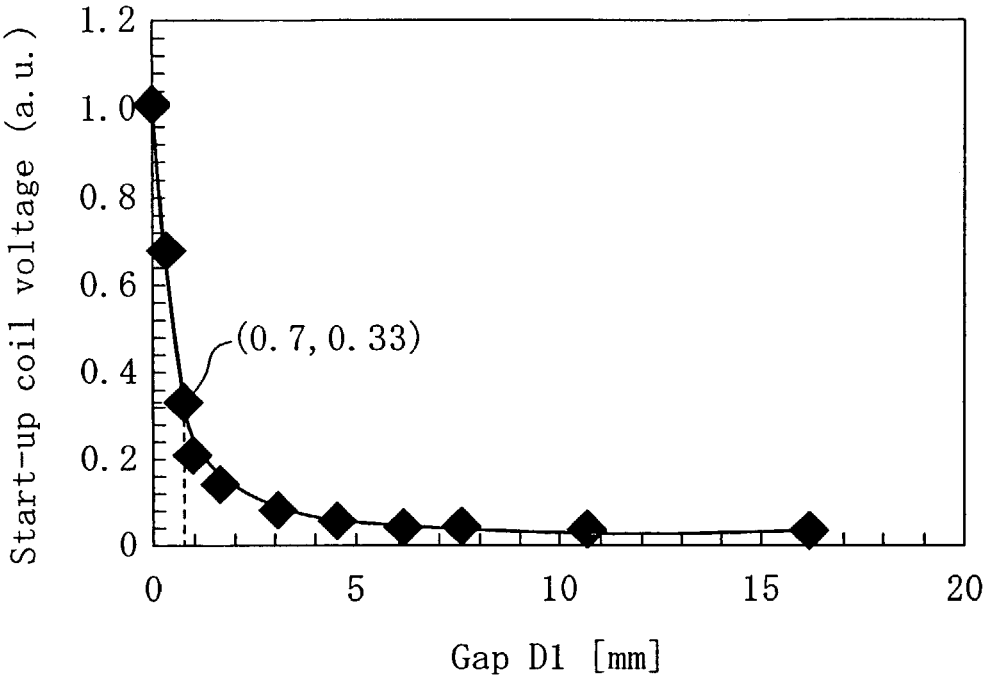
FIG. 3 is a graph showing the relationship between the gap D1 and the start-up coil voltage.

The inventors of the present invention made experiments and examinations as to changes of the start-up coil voltage with respect to various values of the gap D1. FIG. 3 shows an example of the experimental results. The horizontal axis of FIG. 3 shows the gap D1 (mm) between the end portion 127 of the core 123 and the plane portion 165, and the vertical axis shows the values of the start-up coil voltage, which are obtained by normalizing the value of the start-up coil voltage at a gap D1 of 0 mm as 1. As seen from FIGS. 2 and 3, even a small change in the inductance of the induction coil 120 due to a change of the gap D1 causes the start-up coil voltage to change significantly. For example, when the gap D1 between the core 123 and the plane portion 165 reaches 0.7 mm, the startup coil voltage is about 33% of the voltage at a gap D1 of 0 mm, and the electrodeless discharge lamp 10 cannot be started. This means that unless the tolerance in the inductance of the induction coil 120 is suppressed and kept constant, large electromagnetic energy necessary for start-up cannot be supplied to the bulb 110 through the induction coil 120. Therefore, it is very important that the inductance of the induction coil 120 is not changed depending on the manner in which the core 123 is attached.

In order to produce almost no tolerance in the inductance of the induction coil 120 even if the gap D1 between the end portion 127 of the core 123 and the plane portion 165 is slightly changed in assembling the electrodeless discharge lamp 10, it is preferable the gap D1 between the end portion 127 of the core 123 and the plane portion 165 is 5.0 mm or more, and more preferably 7.5 mm or more, which can be seen from FIG. 2. If the gap D1 is set to this value, even if the gap D1 is slightly displaced from the set value in assembling the lamp, the discrepancy between the inductance of the induction coil 120 and the set value is very small. In this embodiment, the tolerance in the inductance at the time of attachment can be suppressed to 0.5% or less when the D1 is displaced from 1 mm by setting the gap D1 to 8 mm, thereby ensuring a high start-up coil voltage. Thus, reliable operation can be achieved and a high light output can be achieved at the same time.

Setting the gap D1 between the end portion 127 of the core 123 and the plane portion 165 as above makes it possible to eliminate adjustment of the inductance after lamp assembly, which is necessary in the technique in Japanese Laid-Open Patent Publication No. 10-69992, so that the production time can be shortened and the production cost can be reduced.

It is preferable that the gap D1 between the end portion 127 of the core 123 and the plane portion 165 is 30 mm or less, for example, in the case of a self-ballasted electrodeless discharge lamp.

Then, the operation of the electrodeless discharge lamp 10 of Embodiment 1 having the structure shown in FIG. 1 will be described.

When commercial power is supplied from the lamp base 150, the commercial power is converted to high frequency current having a frequency of 425 kHz in the inverter circuit of the ballast circuit 130. This high frequency current is supplied to the induction coil 120, so that an alternating electromagnetic field is induced in the bulb 110. The alternating electromagnetic field excites mercury in the bulb 110. Thus, ultraviolet radiation is radiated in the bulb 110, and the ultraviolet radiation is converted to visible radiation in the phosphor layer formed on the inner surface of the bulb 110 and then is radiated to the outside through the bulb 110. The principle of the light emission is the same as that of the conventional technique. A conventional circuit can be used as a specific circuit used as the ballast circuit 130.

In the electrodeless discharge lamp of Embodiment 1 of the present invention, as described above, the length L of the core 123 is 45 mm, the gap D1 between the end portion of the core 123 and the plane portion 165 is 8 mm, and the distance H between the plane portion 165 and the plane of the largest diameter of the bulb 110 is 45 mm. Therefore, even if a tolerance in the gap D1 is generated slightly by firing the core 123 or attaching it, the value of the inductance of the induction coil 120 can be kept substantially constant. Thus, in the electrodeless discharge lamp 10 of the structure of Embodiment 1, impedance matching between the inverter circuit and the load resonance circuit is achieved, so that the resonance frequency of the load resonance circuit can be matched to the driving frequency of the inverter circuit. Therefore, it is ensured that a high resonance voltage (start-up coil voltage) necessary to start the electrodeless discharge lamp can be obtained. This also means that because the operating point of the ballast circuit 130 is stabilized, so that a stress to circuit components by reflected power is small, and the energy efficiency is high in stable operation.

In the description of the conventional techniques, it is described that Japanese Patent Publication No. 5-27945 discloses an electrodeless discharge lamp in which a cylindrical thermal conductive member fixed to a core to dissipate heat generated in the core and a metal housing including a ballast circuit are provided, and the thermal conductive member and the metal housing are electrically insulated from each other by an electrical insulator at the lower end of the thermal conductive member so that the start-up voltage is reduced. However, for the electrodeless discharge lamp disclosed in Japanese Patent Publication No. 5-27945, there is no description of keeping the distance between the core of the induction coil and the metal housing constant. Therefore, in this conventional technique, when the distance between the core of the induction coil and the metal housing is varied, the inductance of the induction coil is varied, as seen from the experimental results described above, and thus the resonance frequency of the load resonance circuit is unmatched to the operation frequency of the inverter circuit. Therefore, in the electrodeless discharge lamp disclosed in Japanese Patent Publication No. 5-27945, even if the start-up voltage can be reduced, a significantly large reduction in the start-up coil voltage due to the tolerance in the inductance of the induction coil cannot be prevented. That is to say, reliable start-up cannot be ensured, unlike in Embodiment 1 in which a tolerance in the inductance of the induction coil can be suppressed. Furthermore, in the electrodeless discharge lamp disclosed in Japanese Patent Publication No. 5-27945, the cylindrical thermal conductive member is insulated from the metal housing by an electrical insulator, whereas in the electrodeless discharge lamp 10 of Embodiment 1, the insert portion 163 and the plane portion 165 are connected, so that the electrodeless discharge lamp 10 of this embodiment is superior in terms of thermal dissipation of the induction coil 120.

Embodiment 2

Figure 4:
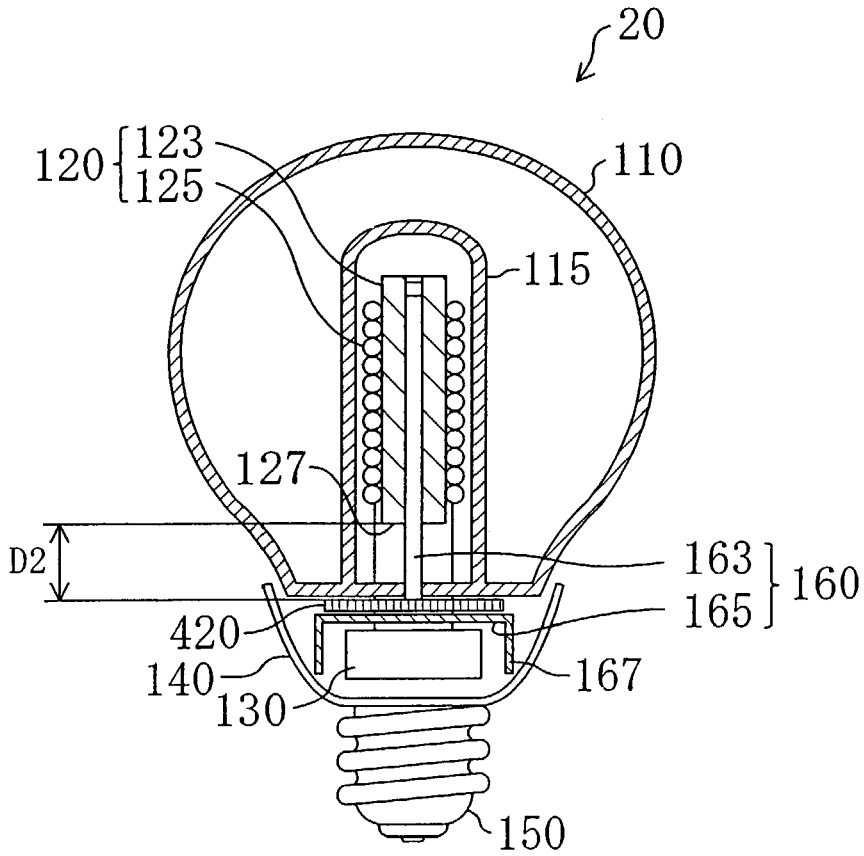
FIG. 4 is a schematic cross-sectional view of a relevant portion of an electrodeless discharge lamp of Embodiment 2 of the present invention.

FIG. 4 shows the outline of the structure of an electrodeless discharge lamp of Embodiment 2 of the present invention. The basic structure of an electrodeless discharge lamp 20 of Embodiment 2 is substantially the same as that of the electrodeless discharge lamp 10 of Embodiment 1, but is different in that a shielding member 420 made of a magnetic material is provided on the surface of the plane portion 165 on the side of the induction coil 120. The same elements as those described in Embodiment 1 bear the same numeral and will not be described further.

The conditions of the core 123 and the winding 125 of the induction coil 120 in Embodiment 2 are the same as those of Embodiment 1. That is, the length L of the core 123 is 45 mm, and Mn—Zn ferrite (a magnetic permeability of about 2,300) is used. A litz wire is used as the winding 125 and the number of windings is 42 turns.

The shielding member 420 for protecting the ballast circuit 130 from the alternating electromagnetic field generated from the induction coil 120 is ferrite, and the gap D2 (second gap) between the end portion 127 of the core 123 on the side of the plane portion 165 and the shielding member 420 is 8 mm, and the distance 12 between the shielding member 420 and the plane including the largest diameter of the bulb 110 is 45 mm.

The structure of the ballast circuit 130 is the same as in Embodiment 1, and will not be described further. The driving frequency of the inverter circuit of the ballast circuit 130 is 88 kHz.

When the shielding member 420 is arranged as shown in FIG. 4, the gap D2 between the end portion 127 of the core 123 and the shielding member 420 is slightly varied by assembly. Thus, the inductance of the induction coil 120 is slightly varied, and the resonance frequency of the load resonance circuit is slightly unmatched to the driving frequency of the inverter circuit. Consequently, the resonance voltage applied across the induction coil 120 for the start-up, that is, the start-up coil voltage is extremely reduced and the lamp cannot be started.

Figure 5:
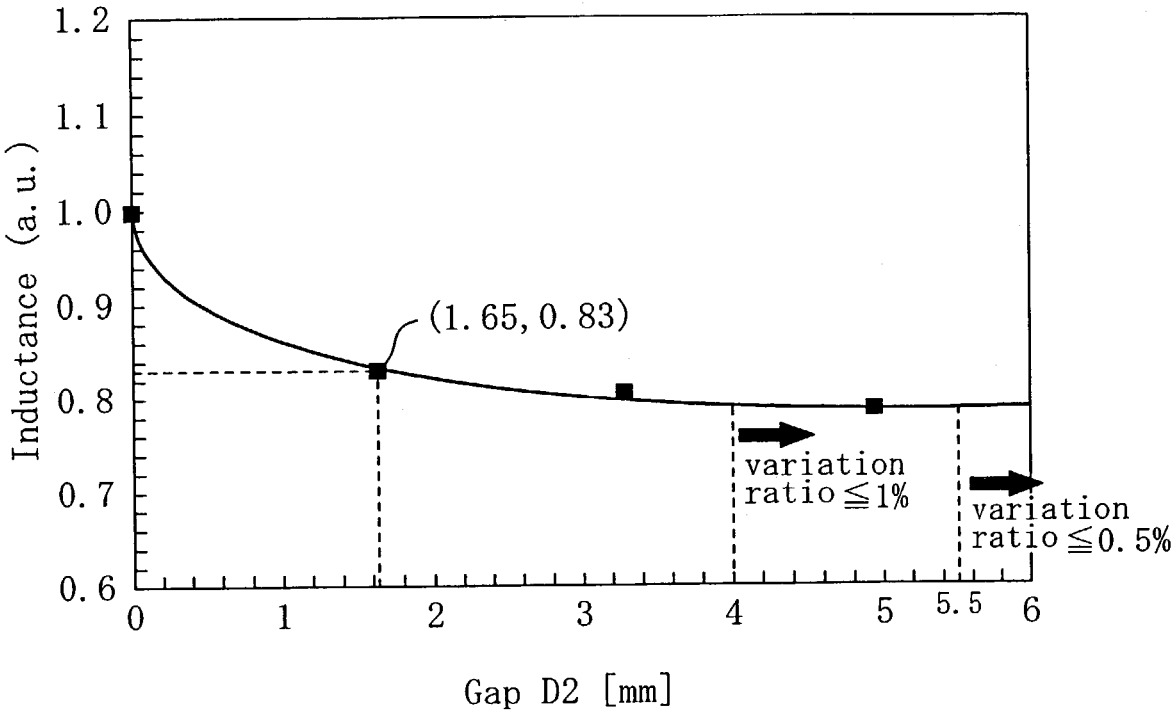
FIG. 5 is a graph showing the relationship between the gap D2 and the inductance of the induction coil.
Figure 6:
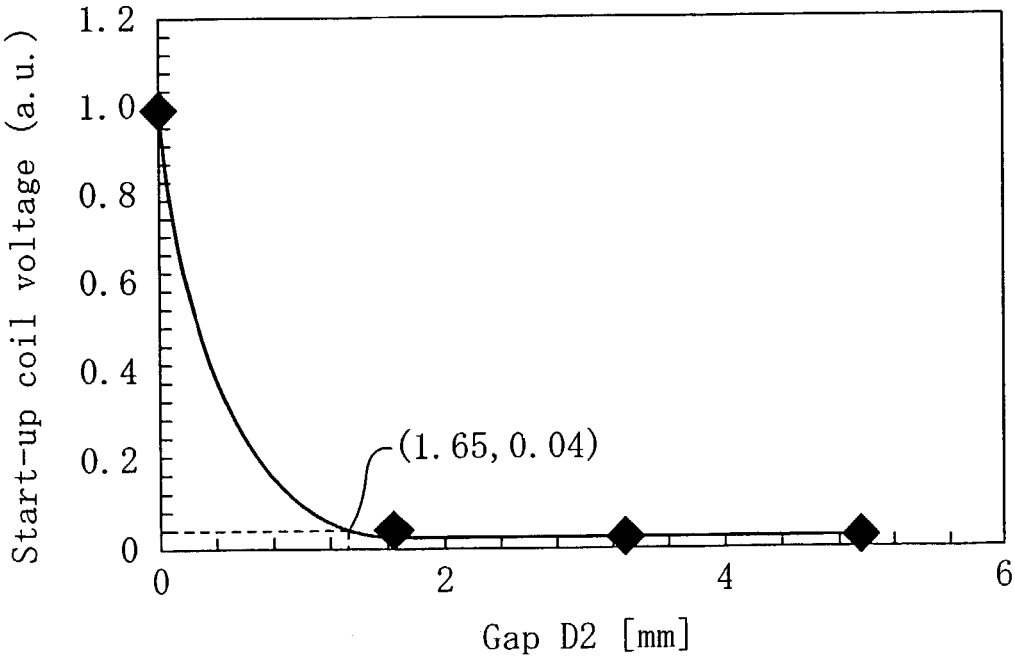
FIG. 6 is a graph showing the relationship between the gap D2 and the start-up coil voltage.

In order to prevent this problem, it is necessary to suppress a tolerance in the inductance of the induction coil 120 of the electrodeless discharge lamp 20 and keep the inductance constant. FIG. 5 shows the experimentally obtained results of a change of the inductance of the induction coil 120 with the varied gap D2 between the end portion 127 of the core 123 and the shielding member 420. In FIG. 5, the vertical axis shows the values of the inductance expressed by normalizing the inductance at a gap D2 of 0 mm as 1, and the horizontal axis shows the gap D2. FIG. 6 shows the experimentally obtained results of a change of the start-up coil voltage with the varied gap D2. In FIG. 6, the vertical axis shows the start-up coil voltage by normalizing the start-up coil voltage at a gap D2 of 0 mm as 1, and the horizontal axis shows the gap D2.

FIG. 5 indicates that for example, the inductance at a gap D2 of 1.65 mm is 83% of the inductance at a gap of 0 mm. Thus, the resonance frequency of the load resonance circuit is shifted to 96 kHz from 88 kHz at a D2 of 0 mm. This shift of the resonance frequency causes the start-up coil voltage to drop sharply to about 4% of the voltage at the time of impedance matching as shown in FIG. 6, so that the electrodeless discharge lamp 20 is not started.

For this reason, it is important that the inductance of the induction coil 120 is not changed even if the induction coil 120 is attached in a slightly displaced position by assembly, in order to start the electrodeless discharge lamp 20 successfully. It is sufficient that the gap D2 is set to 4.0 mm or more, as shown in FIG. 5, in order to limit the tolerance ratio of the inductance to 1% or less even if the gap D2 is displaced by 1 mm. It is sufficient that the gap D2 is set to 5.5 mm or more, in order to limit the tolerance ratio of the inductance to 0.5% or less even if the gap D2 is displaced by 1 mm. In this background, in the electrodeless discharge lamp 20 of Embodiment 2, the gap D2 is 8 mm.

In the electrodeless discharge lamp 20 of Embodiment 2, a tolerance in the gap D2 between the end portion 127 of the core 123 and the shielding member 420 causes a tolerance in the inductance of the induction coil 120, and thus the start-up coil voltage is varied significantly. This manner is similar to the manner in the electrodeless discharge lamp 10 of Embodiment 1 in which a tolerance in the gap D1 between the end portion 127 of the core 123 and the plane portion 165 causes a tolerance in the inductance of the induction coil 120, and thus the resonance voltage is varied significantly. However, in the electrodeless discharge lamp 20 of Embodiment 2, the shielding member 420 is provided, so that the value of the gap D2 can be smaller than the gap D1 in the electrodeless discharge lamp 10 of Embodiment 1. That is to say, Embodiment 2 has an advantage over Embodiment 1 in that the acceptable range of the gap is wider.

With the structure of Embodiment 2, when assembling a lamp, when the gap D2 between the end portion 127 of the core 123 and the shielding member 420 is set to 5.5 mm or more, even if the gap D2 is displaced from the designed specification by ±1 mm, the tolerance ratio of the inductance of the induction coil 120 can be suppressed to 0.5% or less. Thus, a sufficient start-up coil voltage necessary for start-up of the electrodeless discharge lamp 20 can be supplied, so that an electrodeless discharge lamp 20 having a high efficiency and a high optical output can be obtained.

Ferrite is used as the material of the shielding member 420 in Embodiment 2, but the same effect can be obtained even if a magnetic material, for example, a material containing iron is used instead of ferrite.

The heat in the induction coil 120 is released from the thermal conductive member 160 through the cylindrical portion 167 and the case 140 to the outside. Therefore, when the outer diameter of the plane portion 165 is smaller than the outer diameter of the shielding member 420, a gap is generated between the case 140 and the cylindrical portion 167, so that it is possible that heat cannot be dissipated outside efficiently. For this reason, it is preferable that in the electrodeless discharge lamp 20, the outer diameter of the plane portion 165 of the thermal conductive member 160 is not smaller than the outer diameter of the shielding member 420.

The gap D2 between the end portion 127 of the core 123 and the shielding member 420 is preferably 30 mm or less, for example, in the case of a self-ballasted electrodeless discharge lamp.

Embodiment 3

Figure 7:
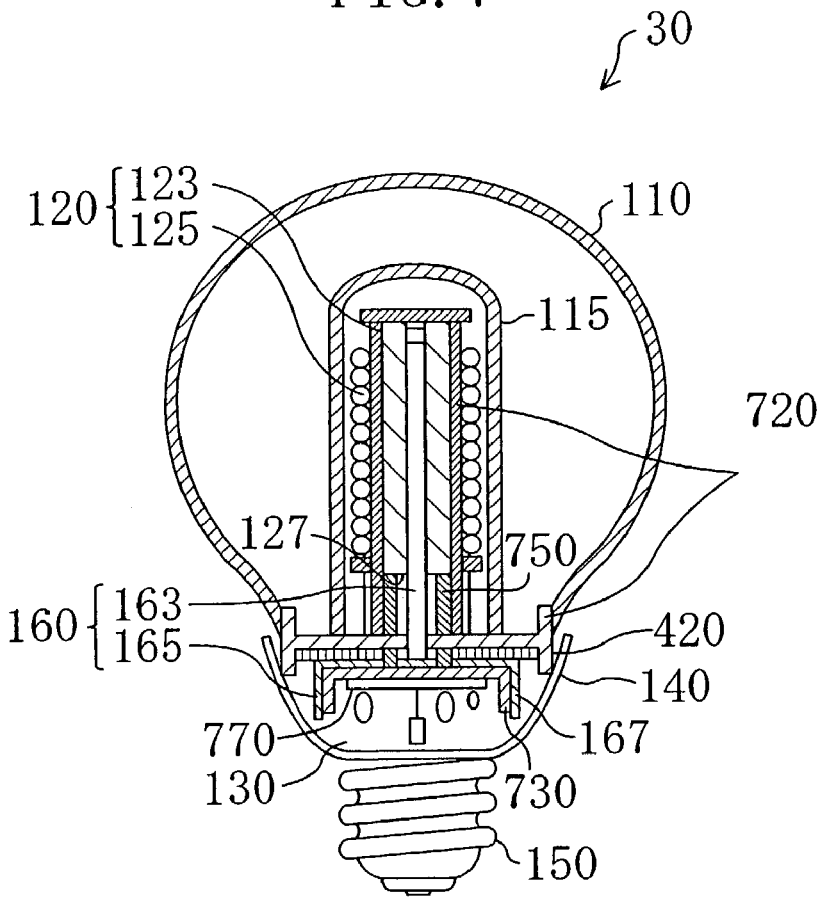
FIG. 7 is a schematic cross-sectional view of a relevant portion of an electrodeless discharge lamp of Embodiment 3 of the present invention.

FIG. 7 shows the structure of an electrodeless discharge lamp of Embodiment 3 of the present invention.

In FIG. 7, basically the same elements as those of the electrodeless discharge lamps 10 and 20 described in Embodiments 1 and 2 bear the same numeral and will not be described further.

The electrodeless discharge lamp 30 of Embodiment 3 is provided with a thermal conductive member 160 including an insert portion 163 and a plane portion 165, and a cylindrical portion 167 in order to dissipate the heat in the induction coil 120, and a disk-like shielding member 420 made of ferrite is provided on the surface of the plane portion 165 on the side of the bulb 110, as in the electrodeless discharge lamp 20 of Embodiment 2.

Furthermore, as shown in FIG. 7, a bobbin 720 for providing the winding around the core 123 of the induction coil 120 is provided. A litz wire is wound 42 turns around the bobbin 720 as the winding 125. The bulb 110 is attached to the bobbin 720 in the vicinity of its bottom.

As shown in FIG. 7, in order to accommodate and hold the ballast circuit 130 constituted by electronic components and a substrate 770, a holding member 730 made of a heat resistant plastic is provided, and the ballast circuit 130 is held by engaging the periphery of the substrate 770 with engagement hooks provided with the holding member 730.

In the electrodeless discharge lamp 30 of Embodiment 3, the gap D2 between the end portion 127 of the core 123 on the side of the plane portion 165 and the shielding member 420 is 6 mm in order to suppress the tolerance in the inductance of the induction coil 120 to 0.5% or less. In order to set the gap D2 to this value, the end portion 127 of the core 123 is supported by a spacer 750. This spacer 750 ensures to keep the gap D2 constant by a simple method.

Figure 8:
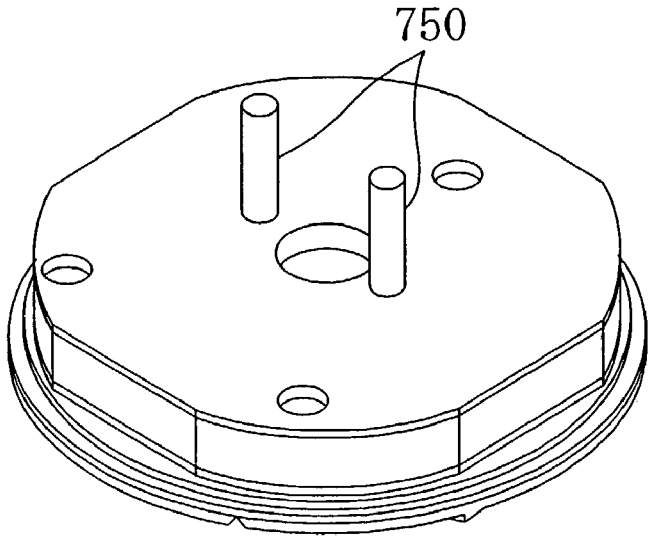
FIG. 8 is a perspective view of a spacer of the electrodeless discharge lamp of Embodiment 3 of the present invention.

The spacer 750 is constituted by a plurality of protrusions provided in the holding member 730, as shown in FIG. 8. These protrusions are formed integrally with the holding member 730 by integral molding. The cost is prevented from increasing by integral molding. The holding member 730 is coupled and fixed to the bobbin 720 with a plurality of engagement hooks (not shown) provided in the bobbin 720.

The driving frequency and the ballast circuit 130 of the electrodeless discharge lamp 30 of Embodiment 3 are the same as those of the electrodeless discharge lamp 20 of Embodiment 2 and therefore will not be described further.

When the electrodeless discharge lamp 30 of this embodiment is used, a tolerance in the inductance of the induction coil 120 is suppressed in the same manner as in Embodiment 2, and a sufficient resonance voltage necessary for start-up of the lamp can be obtained, which makes reliable start-up and operation possible. This is because the description in Embodiment 2 with reference to FIGS. 5 and 6 is also true for this embodiment.

The shape of the protrusions used as the spacer 750 is a cylinder in this embodiment, but any shapes can be used, as long as they can support the core 123. For example, polygonal column, truncated cone or truncated pyramid-shaped protrusions can be used.

The spacer 750 can be configured to be, not a member integrated with the holding member 730 accommodating the ballast circuit 130, but a member constituted only by protrusions or a member constituted by protrusions provided in another member from the holding member 730. Specific structures thereof will not be described further because those skilled in the art would realize them easily.

Figure 9:
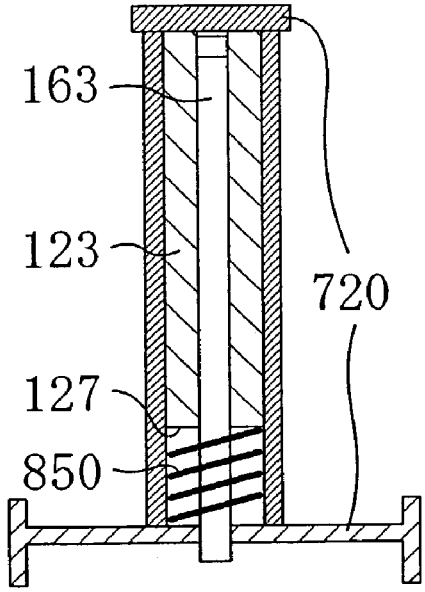
FIG. 9 is a schematic view of another spacer of the electrodeless discharge lamp of Embodiment 3 of the present invention.

Furthermore, as a member serving as the spacer 750, a spring 850 made of a plastic as shown in FIG. 9 can be used instead of the protrusion made of a plastic to ensure the gap D2. A metal spring also can be used instead of the spring 850 made of a plastic, but; in this case, the effect of suppressing a tolerance in the inductance of the induction coil 120 that can be obtained in the electrodeless discharge lamp 30 of Embodiment 3 cannot be obtained. This is because the metal spring used to hold a gap D2 affects the magnetic flux from the induction coil 120. The spacer (including the spring) can be formed of ceramics, glass or the like, which does not affect the magnetic flux and has a high heat resistance. However, it is preferable to use a plastic in terms of the size tolerance or the cost. It should be noted that FIG. 9 shows only the bobbin 720, the core 123, the insert portion 163 and the spring 850 by extracting them.

The shape of the engagement hook for fixing the holding member 730 with the bobbin 720 can be any shape, as long as it is sufficient to fix them.

Embodiment 4

Figure 10:
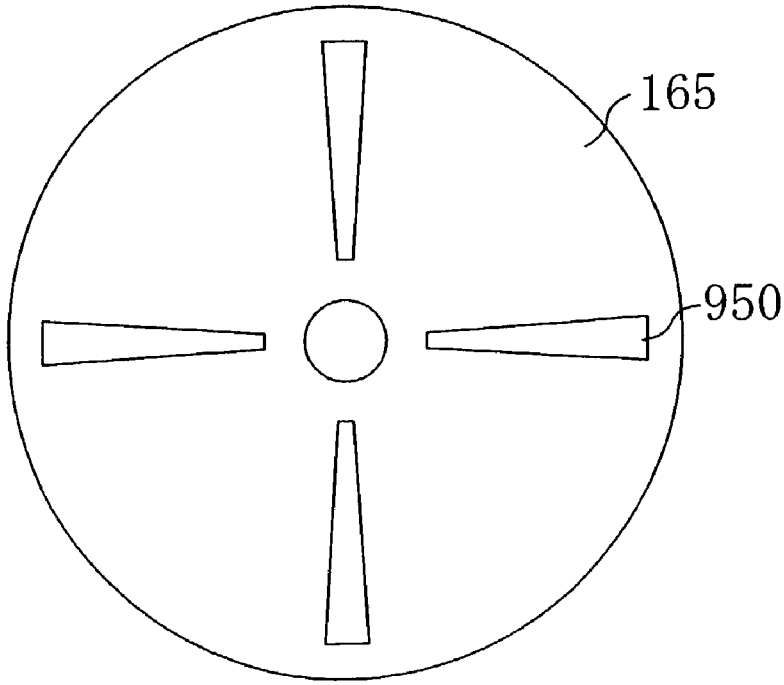
FIG. 10 is a schematic view of a thermal conductive member of an electrodeless discharge lamp of Embodiment 4 of the present invention.

The structure of the electrodeless discharge lamp of Embodiment 4 is basically the same as that shown in FIG. 1 of Embodiment 1, and is different from that of Embodiment 1 only in that the shape of the plane portion 165. FIG. 10 shows a plan view of the plane portion 165 of the electrodeless discharge lamp of Embodiment 4 when viewed from the above.

As shown in FIG. 10, a plurality of slits 950 (holes) are provided in the plane portion 165. The plurality of slits 950 that are provided in this manner increases the resistance of the plane portion 165 made of copper, and thus the eddy current loss generated in the plane portion 165 can be smaller than that of the electrodeless discharge lamp 10 in Embodiment 1, so that an electrodeless discharge lamp having excellent start-up properties and a higher efficiency can be realized.

Also when the slits 950 as shown in FIG. 10 are provided in the plane portion 165 in the electrodeless discharge lamp 20 or 30 having the structure of Embodiments 2 or 3, the eddy current loss can be suppressed and the same effect as in the electrodeless discharge lamp of Embodiment 4 can be obtained.

The shape of the slits 950 shown in FIG. 10 is only an example, and the number thereof is only an example. Any shape or number can be used, as long as it has the effect of suppressing the eddy current loss occurring in the plane portion 165 due to the magnetic flux generated from the induction coil 120.

Other embodiments

In the electrodeless discharge lamps of Embodiments 1 to 4, copper is used as the material of the thermal conductive member 160 to release the heat generated in the induction coil 120 to the outside of the case 140 efficiently. However, the thermal conductive member 160 can be formed of any conductive metal, as long as it has good heat transmission properties. For example, when the thermal conductive member 160 can be formed of aluminum, the same effect as in the electrodeless discharge lamps of Embodiments 1 to 4 can be obtained.

In the electrodeless discharge lamps of Embodiments 1 to 4, when the insert portion 163 and the plane portion 165 that are elements of the thermal conductive member 160 are formed integrally, a curvature having a certain magnitude is formed in a connection portion between the insert portion 163 and the plane portion 165. When this curvature is increased, the induction coil 120 is equivalently close to the plane portion 165, so that this may cause a tolerance in the inductance of the induction coil 120. Therefore, the radius of curvature is set to 2 mm or less so as to produce an electrodeless discharge lamp having a suppressed influence on a tolerance in the inductance of the induction coil 120.

The shape of the bulb 110 of the electrodeless discharge lamp of Embodiments 1 to 4 may be, for example, straight, circular or U-shaped.

The electrodeless discharge lamps of Embodiments 1 to 4 are configured as self-ballasted electrodeless discharge lamps that are intended to substitute by incandescent lamps provided with the lamp base 150. However, an electrodeless discharge lamp without the lamp base also can be used.

In the electrodeless discharge lamps of Embodiments 1 to 4, the shape of the cylindrical portion 167 is not necessarily cylindrical, and any shape can be used, as long as it can release heat transmitted from the plane portion 165 to the outside of the case 140 efficiently. For example, the cylindrical portion 167 can be replaced by a truncated conical portion having a shape of a truncated umbrella hat so that an electrodeless discharge lamp having a large contact area with the case 140 and an enhanced effect of releasing heat can be configured.

In the electrodeless discharge lamps of Embodiments 1 to 4, the shape of the core 123 is not necessarily cylindrical, and it can be polygonal cylinder or one opening of the cylinder can be closed.

In the electrodeless discharge lamps of the Embodiments 1 to 4, an electrodeless discharge lamp without the cylindrical portion 167 is encompassed in the scope of the present invention, although it is not so advantageous in providing the effect of releasing heat as those of Embodiments 1 to 4.

As described above, when the electrodeless discharge lamp having the structure of the present invention is used, the tolerance in the inductance of the induction coil can be suppressed, thereby ensuring reliable start-up and thus an electrodeless discharge lamp having high optical output can be obtained.

The invention may be embodied in other forms without departing from the spirit or essential characteristics thereof The embodiments disclosed in this application are to be considered in all respects as illustrative and not limiting. The scope of the invention is indicated by the appended claims rather than by the foregoing description, and all changes which come within the meaning and range of equivalency of the claims are intended to be embraced therein.

What is claimed is:

1. An electrodeless discharge lamp comprising:

a substantially spherical bulb enclosing a discharge gas and having a cavity;

an induction coil having a substantially cylindrical core made of a magnetic material and a winding wound around the core, arranged in the cavity, and generating an electromagnetic field inside the bulb; and a thermal conductive member having an insert portion a part of which is inserted in a cylindrical hole of the core, and a plane portion arranged outside the core and extending in a form of a brim from an end portion of the insert portion;

wherein the end portion of the core on the side of the plane portion is spaced apart from the plane portion by a first distance, the distance is 7.5 mm or more.

2. The electrodeless discharge lamp according to claim 1, wherein the insert portion and the plane portion are joined, and a radius of curvature of a connection portion where the insert portion and the plane portion are joined is 2 mm or less.

3. An electrodeless discharge lamp comprising:

a substantially spherical bulb enclosing a discharge gas and having a cavity;

an induction coil having a substantially cylindrical core made of a magnetic material and a winding wound around the core, arranged in the cavity, and generating an electromagnetic field inside the bulb;

a thermal conductive member having an insert portion a part of which is inserted in a cylindrical hole of the core, and a plane portion arranged outside the core and extending in a form of a brim from an end portion of the insert portion; and a substantially plate-like shielding member made of a magnetic material that is arranged parallel to the plane portion between the core and the plane portion, wherein the end portion of the core on the side of the plane portion is spaced apart from the shielding member by a second distance.

4. The electrodeless discharge lamp according to claim 3, wherein the second gap is 4.0 mm or more.

5. The electrodeless discharge lamp according to claim 3, wherein the second gap is 5.5 mm or more.

6. The electrodeless discharge lamp according to claim 3, wherein the shielding member contains ferrite or iron.

7. The electrodeless discharge lamp according to claim 3, wherein the second distance is formed by a spacer that is a protrusion.

8. The electrodeless discharge lamp according to claim 7, wherein the protrusion is made of a plastic material.

9. The electrodeless discharge lamp according to claim 7, further comprising:

a ballast circuit having a substrate for supplying power to the induction coil; and a holding member for holding the substrate, wherein the protrusion is formed integrally with the holding member.

10. The electrodeless discharge lamp according to claim 9, further comprising a lamp base for receiving electric power from a line wherein the bulb, the induction coil, the ballast circuit and the lamp base are formed integrally.

11. The electrodeless discharge lamp according to claim 3, wherein the insert portion and the plane portion are joined, and a radius of curvature of a connection portion where the insert portion and the plane portion are joined is 2 mm or less.

12. The electrodeless discharge lamp according to claim 3, wherein a plurality of holes are provided in the plane portion.

13. The electrodeless discharge lamp according to claim 3, wherein an outer diameter of the plane portion is not less than an outer diameter of the shielding member.

14. The electrodeless discharge lamp according to claim 3, wherein a column-shaped cylindrical portion that releases heat from the plane portion to the outside is thermally connected to a periphery of the plane portion in the thermal conductive member.

15. The electrodeless discharge lamp according to claim 14, further comprising a case for covering a ballast circuit, wherein the cylindrical portion is thermally connected to the case.

16. An electrodeless discharge lamp comprising:

a substantially spherical bulb enclosing a discharge gas and having a cavity;

an induction coil having a substantially cylindrical core made of a magnetic material and a winding wound around the core, arranged in the cavity, and generating an electromagnetic field inside the bulb; and a thermal conductive member having an insert portion a part of which is inserted in a cylindrical hole of the core, and a plane portion arranged outside the core and extending in a form of a brim from an end portion of the insert portion;

wherein the end portion of the core on the side of the plane portion is spaced apart from the plane portion by a first distance, and the first distance is formed by a spacer that is a protrusion.

17. The electrodeless discharge lamp according to claim 16, wherein the protrusion is made of a plastic material.

18. The electrodeless discharge lamp according to claim 16, further comprising:

a ballast circuit having a substrate for supplying power to the induction coil; and a holding member for holding the substrate, wherein the protrusion is formed integrally with the holding member.

19. The electrodeless discharge lamp according to claim 18, further comprising a lamp base for receiving electric power from a line wherein the bulb, the induction coil, the ballast circuit and the lamp base are formed integrally.

20. The electrodeless discharge lamp according to claim 16, wherein the insert portion and the plane portion are joined, and a radius of curvature of a connection portion where the insert portion and the plane portion are joined is 2 mm or less.

* * * * *

UNITED STATES PATENT AND TRADEMARK OFFICE

CERTIFICATE OF CORRECTION

PATENT NO. : 6,979,940 B2 
APPLICATION NO. : 10/445117
DATED : December 27, 2005
INVENTOR(S) : Toshiaki Kurachi et al.

It is certified that error appears in the above-identified patent and that said Letters Patent is hereby corrected as shown below:

Colum 12

Line 63, Claim 4: "gap" should be --distance--

Line 65, Claim 5: "gap" should be --distance--

Signed and Sealed this

Twenty-fourth Day of October, 2006

JON W. DUDAS
*Director of the United States Patent and Trademark Office*